US006262534B1

(12) United States Patent
Johnson, Jr. et al.

(10) Patent No.: US 6,262,534 B1
(45) Date of Patent: Jul. 17, 2001

(54) LAMP HAVING LIGHT SOURCE MOUNTED DIRECTLY TO STEM

(75) Inventors: Pierce Johnson, Jr., Richmond, KY (US); Mark Morrell, Bath, NY (US); Chris Heijmans, Waalre (NL)

(73) Assignee: Philips Electronics North America Corp., New York, NY (US)

( * ) Notice: Subject to any disclaimer, the term of this patent is extended or adjusted under 35 U.S.C. 154(b) by 0 days.

(21) Appl. No.: 09/190,668

(22) Filed: Nov. 12, 1998

(51) Int. Cl.[7] ..... H01J 17/18

(52) U.S. Cl. ..... 313/623; 313/318.07; 313/26; 313/315

(58) Field of Search ..... 313/623, 25, 579, 313/634, 318.07, 318.09, 324, 315, 26

(56) References Cited

U.S. PATENT DOCUMENTS

| | | | | |
|---|---|---|---|---|
| 1,956,598 | * | 5/1934 | Sperti | 176/126 |
| 1,989,786 | * | 2/1935 | Brueckmann | 176/122 |
| 3,250,934 | * | 5/1966 | Peterson | 313/17 |
| 4,338,540 | | 7/1982 | Sovilla | 313/220 |
| 4,499,396 | * | 2/1985 | Fohl et al. | 313/25 |
| 4,673,840 | | 6/1987 | Gates | 313/25 |
| 4,687,963 | | 8/1987 | Gagnon et al. | 313/17 |
| 4,709,184 | * | 11/1987 | Keeffe et al. | 313/638 |
| 4,743,803 | | 5/1988 | Lanese et al. | 313/579 |
| 4,754,195 | | 6/1988 | Rasch et al. | 313/626 |
| 4,791,334 | * | 12/1988 | Keeffe et al. | 313/25 |
| 4,888,517 | * | 12/1989 | Keeffe et al. | 313/25 |
| 4,912,360 | | 3/1990 | Meyer . | |
| 5,521,458 | * | 5/1996 | Kuilik, Jr. | 313/25 |
| 5,670,840 | | 9/1997 | Lanese et al. | 313/25 |

FOREIGN PATENT DOCUMENTS

| | | | |
|---|---|---|---|
| 0276780 | 8/1988 | (EP) | H01K/1/34 |

* cited by examiner

*Primary Examiner*—Ashok Patel
*Assistant Examiner*—Matthew J. Gerike
(74) *Attorney, Agent, or Firm*—Dicran Halajian

(57) ABSTRACT

A light source(10) includes a bulb (14) having a pair of outer leads (16,17) extending therefrom in parallel and sealed directly in the glass stem (22), whereby the outer leads (16,17) and the input leads in the glass stem (22) are the same. A protective shroud (30) surrounding the light source (10) may be supported by a metal member (40) welded to one of the leads between the stem (22) and the light source (10). The metal member carries a strap (43) seated in a circumferential constriction (36) of the shroud (30), which may be a commercially available glass vial. In another embodiment, horseshoe-shaped members (18,19) having mutually opposed concavities are welded to respective leads (16,17) and a shroud (30) is locally heated to form a circumferential constriction (36) which shrinks into the concavities, thereby supporting the shroud internally. Alternatively, the shroud can be shrunk directly against the pinch (15) so that it converges toward the open end (35) where it engages leads (16,17).

19 Claims, 4 Drawing Sheets

LAMP HAVING LIGHT SOURCE MOUNTED DIRECTLY TO STEM

BACKGROUND OF THE INVENTION

The invention relates to a lamp of the type having a light source including a bulb having a pair of outer leads extending therefrom, a glass envelope surrounding the light source, and a glass stem fixed to the glass envelope. A pair of input leads sealed in the glass stem are electrically connected to the outer leads of the light source. More particularly, the invention relates to a lamp having a protective shroud surrounding the light source.

U.S. Pat. No. 5,670,840 discloses a lamp having a tungsten halogen light source with a filament connected to electrodes connected to metal foils in pinches at opposite ends of a bulb, and outer leads connected to the foils. The outer leads are welded to mounting legs sealed in the glass stem, the mounting legs serving as input leads. One of the mounting legs supports a tubular shroud of glass or quartz which surrounds the light source and protects the glass envelope from fragments in the event of bulb failure. The shroud is fixed to the mounting leg by means of glass connector brackets adjacent opposed open ends of the tube.

The lamp described in U.S. Pat. No. 5,670,840 requires connecting the shroud to a mounting leg at two places by relatively fragile glass connections, subsequently welding the outer leads of the light source to the mounting legs, followed by sealing the mounting leg to the stem.

U.S. Pat. No. 4,888,517 in FIG. 6 discloses a metal halide light source having a pair of electrodes connected to metal foils in a pinch at one end of the bulb, and side-by-side outer leads connected to the foils. The outer leads are welded to input leads sealed in the glass stem. A glass shroud surrounds the light source, the shroud having a cylindrical wall, an open end toward the stem, and an opposed closed end. The shroud is supported by mounting legs which are also welded to respective input leads, the legs being fixed to metal straps surrounding the shroud adjacent respective ends. While the closed end of the shroud provides additional protection for the envelope in the event of bulb failure, multiple welding steps are required to connect the light source to the input leads and to complete the shroud support. Further, since it is necessary to support the shroud by means of a strap adjacent the closed end, the corresponding leg must be loaded against the lamp envelope for stability.

It would be desirable to provide a unified mount structure for supporting the light source, and further to provide simplified and reliable means for positioning a protective shroud about the light source.

SUMMARY OF THE INVENTION

According to the invention, the outer leads extending from the bulb of the light source are sealed directly to the glass stem without any intervening welds. The outer leads are thus one and the same as the input leads sealed in the glass stem.

The invention is most applicable for outer leads which extend in parallel from a pinch at one end of the bulb.

According to another aspect of the invention, a protective shroud surrounding the light source is supported by a metal member having a lower end fixed to one of the leads, and an upper end fixed to a strap surrounding the shroud. The shroud is preferably in the form of a glass vial having a substantially cylindrical wall, an open end adjacent to the stem, an opposite closed end, and a circumferential constriction in the wall adjacent to the open end. The support strap is seated in the circumferential constriction, providing good vertical positioning for the shroud. The metal member may be extended to an additional strap positioned around the upper end of the shroud for improved lateral stability.

A vial having a circumferential constriction is a readily available staple in commerce, thus providing failure protection which is both economic and simple to fix to the support structure.

According to another embodiment, a pair of horseshoe-shaped mounts with mutually opposed concavities are welded to respective leads between the light source and the stem, and a protective glass shroud has a circumferential constriction which is formed into the concavities. The shroud is conveniently a small test tube which is placed about the light source and heated, causing it to shrink into the concavities.

It is also possible to shrink the shroud directly against the pinch sealing the outer leads of the light source, avoiding the need for individual shroud supports fixed to the leads. The shroud preferably converges from the cylindrical portion all the way to the open end so that it also engages the outer leads. This embodiment provides good stability at low cost.

The mount structure of the invention thus provides a simple but sturdy support for both the light source and the shroud by sealing the outer leads of the light source directly to the stem.

DETAILED DESCRIPTION OF THE PREFERRED EMBODIMENTS

Figure 1:
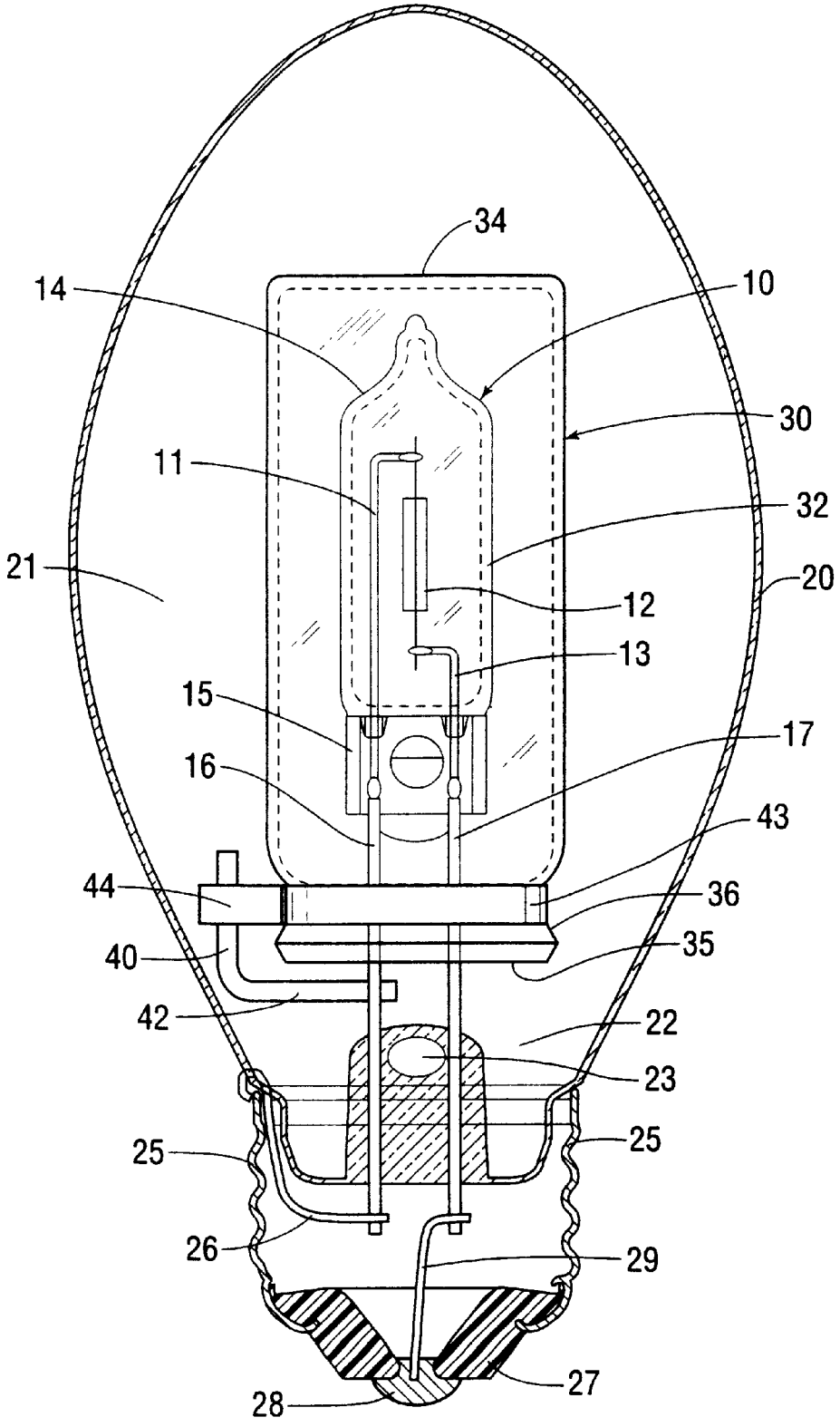
FIG. 1 is a side view of the lamp according to the invention, with the base shown in cross-section.

Referring to FIG. 1, the light source 10 is a tungsten halogen incandescent lamp having a first inner lead 11, a second inner lead 13, and a tungsten filament 12 therebetween. The bulb 14 has at one end a pinch 15 in which the inner leads 11, 13 are connected to respective outer leads 16, 17 in known fashion for sealing purposes. Outer leads 16, 17 extend from the pinch 15 substantially in parallel.

A glass envelope 20 encloses a fill space 21, and is fixed to a glass stem 22 formed with an evacuation port 23 which is sealed off subsequent to evacuation. The outer leads 16, 17 are sealed directly to the glass stem 22, without any bends or welds, and thus are one and the same as input leads in the glass stem. An electrically conductive base 25 is fixed to the glass envelope 20 and electrically connected to the first outer lead 16 by a base lead 26. An electrical conductive center contact 28 is fixed to the base 25 by insulative epoxy 27 and electrically connected to second lead 17 by center lead 29.

A protective shroud 30 surrounds the light source 10 and protects the outer envelope 20 from fragments of bulb 14 in the event of non-passive failure. The shroud 30 has a cylindrical wall 32, a closed end 34, an opposed open end 35 toward the stem 22, and a circumferential constriction 36 in the wall 32 adjacent to open end 35. The shroud 30 is conveniently a vial of boro-silicate glass of the type used in an auto sampler, available in various sizes from Kimble Glass Inc. of Toledo, Ohio. For example a vial having a capacity of 27 ml, an OD of 30 mm, and a length of 60 mm was found to be useful for a 90watt tungsten halogen bulb.

The shroud 30 is supported by a metal member 40 having a lower end 42 welded to first lead 16, a circumferential strap 43 having a tab 44 welded to member 40, and a ninety degree bend therebetween. The strap 43 is seated in circumferential constriction 36, thus positioning the shroud 30 about the light source.

Figure 2:
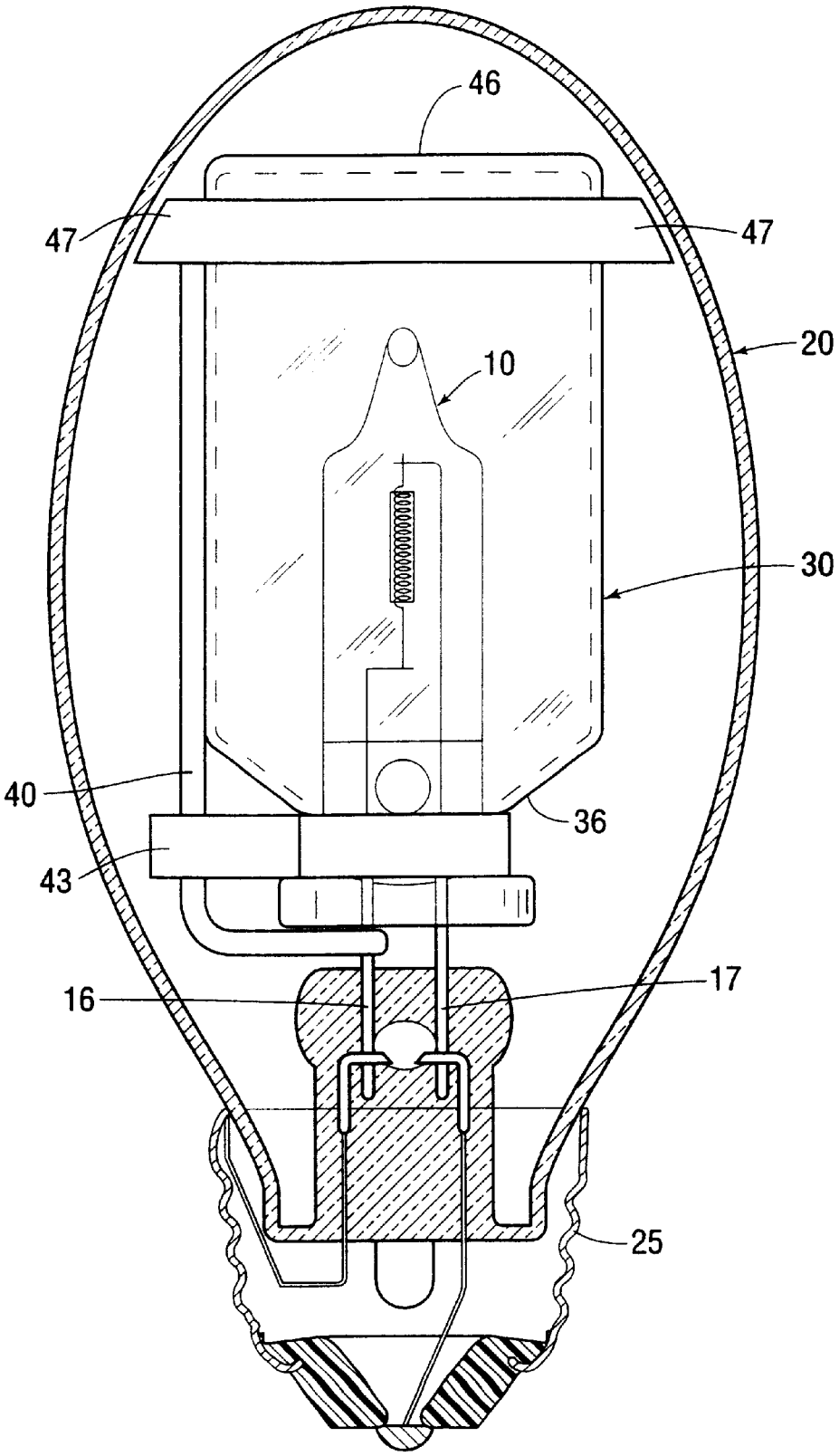
FIG. 2 is a side view of an embodiment having a shroud with two support straps.

FIG. 2 shows an embodiment in which the support member 40 is extended to an upper circumferential strap 46 having tabs 47 which are seated against the outer glass envelope 20. Since the lower strap 43 is fitted in the circumferential constriction 36, vertical stability is assured without tightly fitting the upper strap 46, which is provided for lateral stability.

Figure 3:
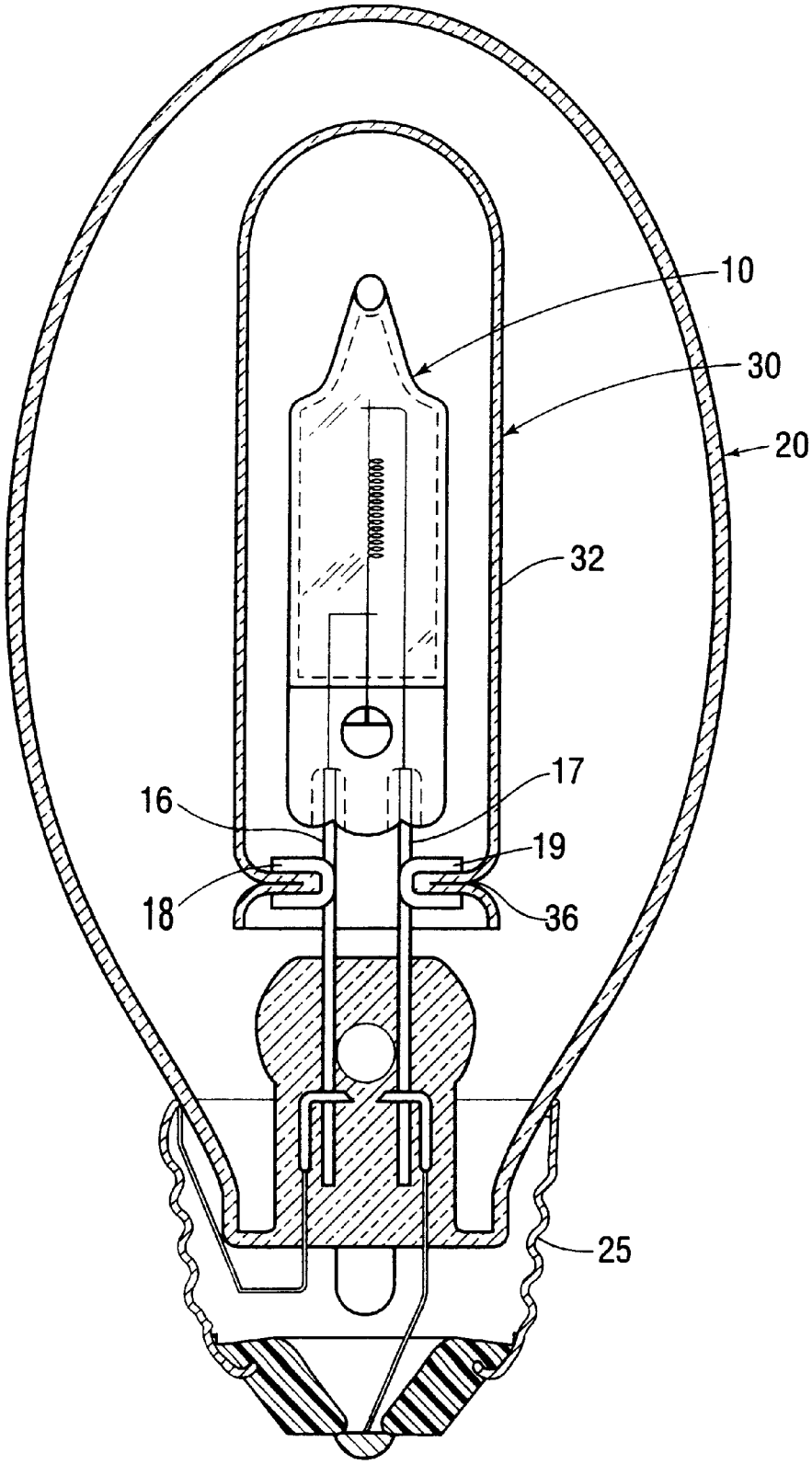
FIG. 3 is a side view of an embodiment with a shroud fixed to shroud supports on the leads.

FIG. 3 shows an embodiment having a light source 10 as in the other figures, and a protective shroud 30 which has been locally heated to form the circumferential constriction 36. This forms it into mutually opposed concavities in horseshoe shaped supports 18, 19 welded to respective leads 16, 17. This firmly fixes the shroud 30 with respect to the stem 22, without the need for any additional support. The outer envelope is then sealed to the stem, and the base 25 is emplaced.

Figure 4:
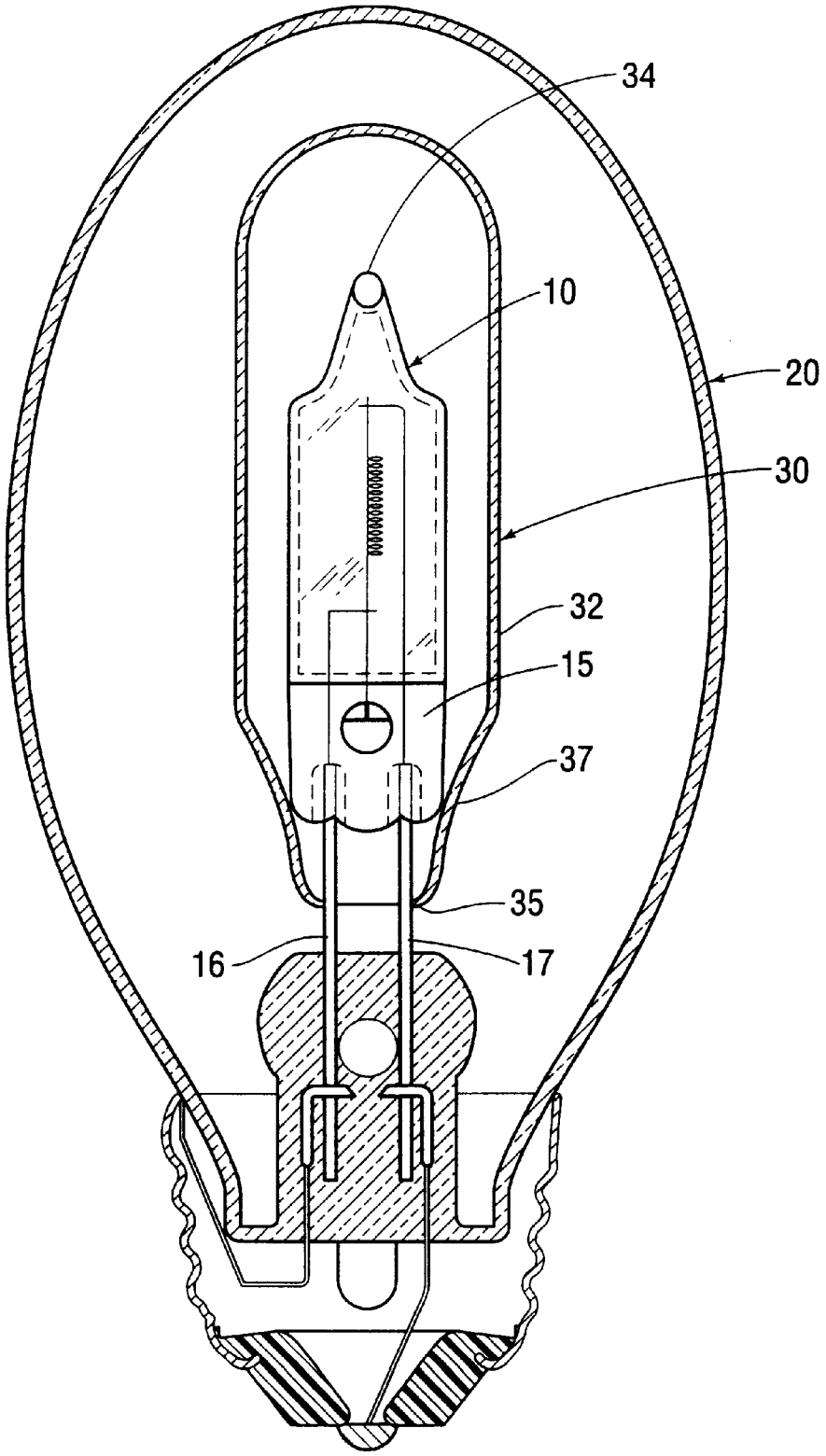
FIG. 4 is a side view of an embodiment with the shroud fixed directly to the sealing pinch of the light source.

FIG. 4, like the other figures, shows a light source 10 having a pinch 15 which seals leads 16, 17. Here a circumferential constriction 37 is formed directly against the pinch 15 to position the shroud 30 with respect to the lamp 10. For extra stability the constriction 37 converges from the cylindrical portion 32 to the open end 35, where it also engages the leads 16, 17.

While a tungsten halogen incandescent lamp has been disclosed, the principles of the invention are equally applicable to a discharge lamp, in particular a metal halide arc tube having parallel leads which can be sealed directly to the stem. Likewise a glass vial with circumferential constriction for a single support strap could be used to protect an arc tube.

The foregoing is exemplary and not intended to limit the scope of the claims which follow.

We claim:

1. A lamp comprising:

a light source, a glass envelope surrounding said light source, a glass stem fixed to said glass envelope, a shroud surrounding said light source and having a circumferential constriction, and a shroud support comprising a pair of respective mutually opposed concavities which are engaged by said circumferential constriction.

2. A lamp as in claim 1 wherein said light source comprises a bulb having a pair of outer leads extending therefrom, and wherein said outer leads are sealed directly to said glass stem.

3. A lamp as in claim 2 wherein said leads extend from said bulb toward said glass stem at least substantially in parallel.

4. A lamp as in claim 2 wherein said shroud support is fixed to one of said outer leads.

5. A lamp as in claim 2 wherein said shroud support is fixed to said outer leads, and said shroud is glass and comprises a substantially cylindrical wall, and an open end toward said stem, said circumferential constriction being toward said open end and engaging said shroud support internally of said shroud to fix said shroud with respect to said leads.

6. A lamp as in claim 1 wherein said shroud support comprises a metal member and a circumferential strap, said metal member having a lower end welded to an outer lead of said light source and an upper end welded to said strap, said strap surrounding said shroud.

7. A lamp as in claim 1 wherein said shroud is a glass member comprising a substantially cylindrical wall, and an open end toward said stem, said circumferential constriction being toward said open end, and said strap being seated in said circumferential constriction.

8. A lamp as in claim 7 wherein said glass member further comprises a closed end opposite said open end.

9. A lamp as in claim 7 wherein said circumferential constriction converges from said cylindrical wall toward said open end.

10. A lamp as in claim 7 wherein said circumferential constriction converges from said cylindrical wall toward said open end, said constriction engaging leads extending from said light source.

11. A lamp as in claim 1 wherein said light source is a tungsten halogen incandescent lamp.

12. A lamp as in claim 1 wherein said shroud support comprises a pair of members fixed to leads of said light source between said light source and said stem, said circumferential constriction engaging said pair of members.

13. A lamp as in claim 12 wherein said circumferential constriction is formed against said pair of members by localized heating.

14. A lamp as in claim 1 wherein said light source comprises a pinch fixed to leads of said light source, said circumferential constriction engaging said pinch.

15. A lamp as in claim 14 wherein said circumferential constriction is formed against said pinch by heating.

16. A lamp of the type comprising a light source comprising a bulb having a pair of outer leads extending therefrom, a glass envelope surrounding said light source, a glass stem fixed to said glass envelope, a pair of input leads sealed to said glass stem and extending from said glass stem toward said light source, said input leads being electrically connected to said outer leads extending from said light source, a glass shroud surrounding said light source, said shroud comprising a substantially cylindrical wall, an open end toward said stem, and a circumferential constriction toward said open end, and a shroud support comprising a pair of respective mutually opposed concavities which are engaged by said circumferential constriction.

17. A lamp as in claim 16 wherein said shroud has a closed end opposite from said open end.

18. A lamp as in claim 16 wherein said input leads are one and the same as said outer leads of said light source, whereby said outer leads are sealed to said glass stem.

19. A lamp as in claim 16 wherein said shroud support comprises a metal member and a circumferential strap, said metal member having a lower end welded to one of said input leads and an upper end welded to said strap, said strap being seated in said circumferential constriction.

* * * * *